United States Patent [19]

Koshizuka et al.

[11] Patent Number: 4,927,693

[45] Date of Patent: May 22, 1990

[54] THERMAL TRANSFER RECORDING MEDIUM AND ITS MANUFACTURING METHOD

[75] Inventors: Kunihiro Koshizuka; Toshiaki Tezuka; Takao Abe; Harue Ebisawa, all of Hino, Japan

[73] Assignee: Konica Corporation, Tokyo, Japan

[21] Appl. No.: 300,614

[22] Filed: Jan. 23, 1989

[30] Foreign Application Priority Data

Jan. 26, 1988 [JP] Japan ..... 63-16357
Jan. 26, 1988 [JP] Japan ..... 63-16359
Feb. 24, 1988 [JP] Japan ..... 63-42474

[51] Int. Cl.[5] ..... B41M 5/26; B41J 31/06

[52] U.S. Cl. ..... 428/141; 428/195; 428/201; 428/336; 428/484; 428/488.1; 428/913; 428/914; 428/206; 428/207; 428/323; 428/408

[58] Field of Search ..... 428/484, 488.1, 488.4, 428/913, 914, 141, 195, 201, 207, 323, 336, 206, 408

[56] References Cited

FOREIGN PATENT DOCUMENTS 208385 1/1987 European Pat. Off. ..... 428/488.4

*Primary Examiner*—Pamela R. Schwartz
*Attorney, Agent, or Firm*—Frishauf, Holtz, Goodman & Woodward

[57] ABSTRACT

A thermal transfer recording medium having an anchor layer containing a resin component and carbon black between a thermally fusible colorant layer and a support and its manufacturing method are disclosed.

10 Claims, 1 Drawing Sheet

THERMAL TRANSFER RECORDING MEDIUM AND ITS MANUFACTURING METHOD

FIELD OF INVENTION

This invention relates to a thermal transfer recording medium and it manufacturing method and, more particularly, relates to the medium and its manufacturing method having an excellent secret preservability because it does not make so-called void part which sometimes emerges the figure of printed image on the anchor layer being remained on the support after transferring the image, and having a good peelability of ink-layer, high sensitivity, good readability of the obtained lusterless image and an excellent printing quality and, more over, having an excellent steady productivity (safe and easy production) and is preferably usable as a thermal recording medium of facsimile, printers and the like.

BACKGROUND OF THE INVENTION

The usual method of thermal transfer recording is to employ a thermal transfer recording medium having a thermally fusible ink layer which is made by dispersing a coloring material in fusible substance on the supporting sheet and to heat the medium from the supporter side with a thermal head in the state superposing the ink layer on a receiving medium (usually a sheet of paper) and to transfer the melted ink layer on the receiving medium resulting to figure an ink image responding to heated portions.

This transfer-type thermal recording method has, however, a short point that the readability is not good because of the high lusterness of the obtained image.

Some ideas are proposed to remove this lusterness of printed image such as that, for example, the formation of irregularity on the surface of the thermally fusible colorant layer (that is, the surface of printed image) transferred on an image receiving layer by coating the thermally fusible colorant layer on a matted support (Japanese Patent Laid Open Publication No. 1985-212392) and the formation of irregularity on the surface of printed image by making a matt-layer or lusterness-control layer (both the layers are called "matt layer" hereafter) containing a resin and a delustering pigment on the base film and setting a thermally fusible colorant layer superposing on the matt-layer (Japanese Patent Laid Open Publication No. 1985-101083 and No. 1986-84287).

These thermal transfer recording medium produce a so-called void on the support corresponding the figure of transferred thermally fusible ink layer after the thermally fusible ink layer is transferred and the recorded content is made possible to read out. It proves the possibility of the leakage of secret.

Accordingly, consideration for secret preservation was utterly neglected in conventional type thermal transfer recording mediums. Since the irregularity formed on the surface of printed image is not satisfactorily fine, the removal of lusterness of the printed image is not complete. Readability is, therefore, not satisfactory depending on the angle of eyes.

Steady productivity could not be obtained for the manufacture of conventional type thermal transfer recording mediums because of the following reasons. In case of the thermal transfer recording medium having the irregularity on the support (refer to Japanese Patent Laid Open Publication No. 1985-2123929), the operation for irregularity treatment is complicated. In case of the thermal transfer medium having matt-layer (refer to Japanese Patent Laid Open Publication No. 1985-101083 and No. 1986-84287), the handling of an organic solvent for coating matt-layer is troublesome and unevenness of the coating layer is liable to cause.

It also left much room for improvement in quality of printing and the sensitivity.

The ink layer of thermal transfer recording mediums should be transferred exactly with a thermal head according to the state of each heated portion. That is to say, the ink layer of the thermal transfer recording medium should be peeled exactly from its support according to the state of heated portions. To satisfy this condition, a conventional technique has been used to apply a layer called a peelling layer between the support and the ink layer.

The peeling layer contains a thermally fusible substance such as wax as the main component and also contains a thermoplastic resin. This layer is applied on the support by coating components melted by heating or components dissolved or dispersed in an organic solvent.

For the purpose to obtain a good quality printed image it is desirable that the ink layer can be transferred from the support to the transferable medium with surface peeling which peels between peeling layer and the adjacent ink layer.

In case of the conventional peeling layers there has been troublesome problems such as surface peeling which occurs between the support and the adjacent peeling layer and the cohesive failure which occurs inside of the peeling layer. A desirable good printed image cannot be obtained if these phenomena happened.

Specially when the peeling layer is applied on the support by using an organic solvent there are many drawbacks such as the deterioration of the workplace environment, the necessity to equip a special fire-preventiven device or the increase of the production cost.

SUMMARY OF THE INVENTION

This invention has been carried out in these circumstances.

The purpose of this invention is to provide a thermal transfer recording medium and its manufacturing method which possesses the following qualities: (1) an excellent secret preservability because of the lack of the void which makes the deciphering possible by remaining the figure of original printed image on the support after transferring; (2) a good peelability of ink layer; (3) a high sensitivity; (4) the obtained printed image is lusterless and has a good readability; (5) an excellent quality of the obtained printed image; (6) easy and safe manufacturing method; (7) a steady productivity.

BRIEF DESCRIPTION OF THE FIGURES

FIG. 2(*b*) shows fine irregularity at the surface of the printed image which results from use of the thermal transfer recording medium according to this invention.

DETAILED DESCRIPTION OF THE INVENTION

To solve these problems, the inventors carried out investigation and obtained a thermal transfer recording medium which has the anchor layer containing a resin component and carbon black (more perferably, mixing ratio of carbon black and resin should have a specified values) between the support and the thermally fusible colorant layer. The obtained medium has properties such as the excellent secret preservability, lusterless and readable printed image, and, moreover, an excellent peelability and sensitivity, and a steady productivity.

The composition of this invention is a manufacture of thermal transfer recording medium having an anchor layer between the support and the thermally fusible colorant layer.

The anchor layer contains a resin component and carbon black and, preferably, carbon black content of said anchor layer is not less than 25 wt %.

A thermal transfer recording medium prepared by setting a ruggid surface layer between the support and the thermally fusible colorant layer has a high sensitivity and can produce high-grade lusterless printing. We found that such kind of medium could easily be manufactured with a special procedure and reached to this invention.

This thermal transfer recording medium has an anchor layer containing resinous component between the support and thermally fusible colorant layer and having a irregular surface.

This medium can be manufactured with a special application method which includes an incomplete levelling application. That is, an anchor layer is unevenly coated on the support by a gravure roll coating method or by disturbing the smoothness on the wet surface before drying up.

Thermal transfer recording medium

Figure 1:
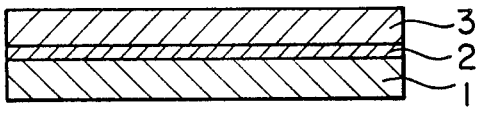
FIGS. 1 and 3 show thermal transfer recording media of this invention.
Figure 3:
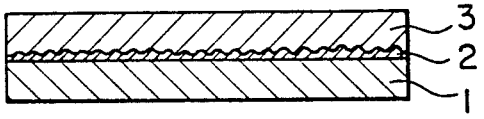

The thermal transfer recording medium of this invention is made from at least three-layered pilling,—that is, (1) a support, (2) an anchor layer and (3) a thermally fusible colorant layer. [FIGS. 1 and 3]

Support

It is desirable that the support of the thermal transfer recording medium of this invention should have a high heat resistance and a high dimensional stability.

Anchor layer

An important point of this invention is to prepare the anchor layer containing a resinous component and carbon black between the previously-mentioned support and the thermally fusible colorant layer which will be described in the following.

The anchor layer of this invention has the action or the function to remove the lusterness of the surface of printed image by forming a fine irregularity on the surface of the thermally fusible colorant layer (that is to say, the surface of the printed image) and also has the action or the function to accelerate the surface-peeling of anchor layer and colorant layer resulting the improvement of peeling of thermally fusible colorant layer and the quality of printed image. This action or the function of the anchor layer is derived from the properties of resinous component and carbon black contained in the anchor layer.

The aforementioned resious component has the function to bring a good quality of printing and high sensitivity by accelerating the surface peeling of anchor layer and thermally fusible colorant layer.

Preferable resins applicable as the aforementioned resinous component should have a good adhesive power with the afore-mentioned support. Example are unsaturated polyester, glyptal resins, modified glyptal resins, phthalic resins modified with unsaturated alcohol, isophthalic acid resins, telephthalic acid resins, polyester resins such as aliphatic polyesters, polyurethane resins; vinyl chloride series resins such as vinyl chloride resin, vinyl chloride-vinyl acetate copolymer, vinyl chloride-vinylidene chloride copolymer, vinyl chloride-acrylic acid esters, vinyl chloride-metacrylic acid copolymer, vinly chloride-acrylonitrile copolymer, ethylene-vinyl chloride copolymer, propylene-vinyl chloride copolymer; vinylidene chloride resin; polyamide resins such as nylon 66, nylon 610, nylon 8, nylon 11; polyacetal; polycarbonate; polysulfone; phenolic resin series such as phenolic resins, phenolic modified resins; melamine resin series such as melamine resin, urea-melanine, resin, phenol-melamine resin; acrylic resin series such as polyacrylic acid ester, polyacrylic acid methyl ester, polyacrylic acid butylester; fluororesin series; epoxy resins; polystyrene resin series such as ABS resin, AS resin, ACS resin; silicone resins; and moreover, water-soluble polymers such as polyvinyl alcohol, polyvinyl pyryolidone, gelatine, carboxymethyl cellulose, methyl cellulose, polyethylene oxide, gum arabic, water-soluble polyesters, water-soluble polyurethane, water-soluble polyacryl, water-soluble polyamides.

These resins can be used either independently or as a mixture of two or more kinds.

A resin having a softening point of not less than 100° C. is preferable. The one having a softening point of not less than 150° C. is more preferable. If the softening point is lower than 100° C., the application of thermally fusible colorant layer on the anchor layer with hot-melt method is sometimes difficult to perform.

In case polyethylene telephthalate is used as the material of the support the use of polyurethane, polyester and polyacrylic resins and their water-soluble resins are preferable. These resins have good adhesive properties with polyethylene telephthalate. When water-soluble resins are used the anchor layer can be coated with water coating method whose productive stability is preferable.

The contents of resinous component in the anchor layer is usually not more than 75 wt % and is preferably not more than 70 wt %. If the content of resin exceeds 75 wt %, the effectiveness of this invention cannot function nicely because of the relative decrease of the content of carbon black.

Ratio of carbon black is one of the important factors in this invention. It should be not less than 25 wt %, or preferably, be 30 wt % or higher to 100 wt % of the anchor layer component.

Carbon black turns the anchor layer black and prevents the voiding of the anchor layer remaining in the support after the transferring of printed image resulting the good secret preservability of recorded medium. Moreover, carbon black helps to increase the surface peelability of the anchor layer and the thermally fusible colorant layer resulting the improvement of the quality of print and also acts to form the fine irregularity on the surface of printed image resulting the removal of lusterness of image surface. Removal of lusterness of image surface seems to be attained by the following mechanism.

Figure 2:
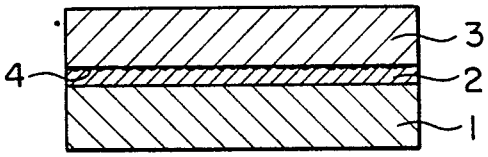
FIG. 2(*a*) shows the movement of a portion of the components of the thermally fusible colorant layer (3) to the adjacent anchor layer (2) so as to compensate the oil absorption of the anchor layer.
Figure 2:
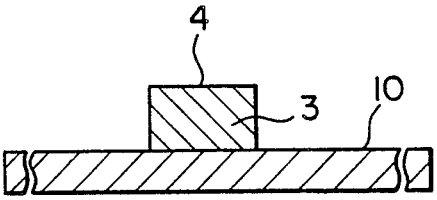

Existence of carbon black in the anchor layer at a specified ratio results the shortage of oil absorption in the layer. As shown in FIG. 2 (*a*), a part of the components in the thermally fusible colorant layer (3) moves to the adjacent anchor layer (2) so as to compensate the oil absorption of the anchor layer (2).

If the surface peeling occurs between the anchor layer and the thermally fusible colorant layer, the fine irregularity is formed at the boundary between anchor layer (2) and the thermally fusible colorant layer (3) resulting the formation of fine irregularity (4) at the surface of printed image as shown in FIG. 2 (*b*).

Formation of remaining lusterness is not observed since this irregularity (4) is finer than the irregularity of the prescribed thermal transfer recording medium (refer to Japanese Patent Laid Open Publication No. 1985-212392; No. 1985-101083; No. 1986-84827). By the way, No. 10 of FIG. 2 (*b*) indicates the medium transferred.

Oil absorption of carbon black (DBP) necessary for this preferable effect is usually 20 ml/100 g or higher and, more preferably, higher than 40 ml/100 g and lower than 300 ml/100 g.

The mean diameter of carbon black particle is usually not more than 100 mμ, or preferably not more than 50 mμ.

Except resinous component and carbon black, the mixture of some filling agent is also preferable. Filling agent can produce an effect in increasing the removal of lusterness of the image surface by adjusting the thickness of its irregularity which has been obtained by action of carbon black.

Preferable diameter of the filling agent to exhibit this effect completely is usually in the range of 0.2–2.0 μm. Following substances can be used as a filling agent: silica, talc, calcium carbonate, alumina, terra abla (acid clay); clay, magnesium carbonate, tin oxide, titanium white, graphite, hardening resin granule, silicone resin granule, fluorine resin granule, melamine resin granule, acrylic resin granule, styrene resin granule, boron nitride, copper, iron, aluminum, iron oxide, and titanium nitride.

The centent of a filling agent in the anchor layer is 3–70 wt % of the total anchor components and, more preferably, 5–40 wt %. Carbon black is applicable with aqueous coating method by dispersing it in water.

The anchor layer can contain thermally fusible compounds, waxes or surface active agents except above-mentioned carbon black and filling agents.

As the waxes for mixing, the followings can be used: vegetable waxes such as carnauba wax, Japan tallow, auricula wax, esparto wax; animal waxes such as honey wax, insect waxes, shellac wax, whale wax; petroleum waxes such as paraffine wax, microcrystal wax, polyethylene wax, ester wax, ester wax, acid wax; mineral wax such as montan wax, ozokerite, ceresin wax; polyester wax, polyamide wax, polyurethane wax.

Among these waxes, especially preferable waxes are polyester, polyamide and polyurethane waxes. Polyester, polyamide and polyurethane waxes will be illustrated below in detail.

(a) Polyester wax

In this invention polyester wax means that has three or more ester bondings (—CO—O—) in one molecule and has weight average molecular weight (Mw) in a range 300–12000 and melting point in a range 30°–120° C. The ester bonding is contained in the main chain of the molecule.

Such compounds can be obtained as polymerization condensation products of a polyvalent alcohol and a polybasic acid or open-chain polymer of lactone compounds.

Typical examples of polyester wax are:

(1) Polymerization condensation product of adipic acid and 1,4-butanediol (Mw=2000, melting point: 55° C.)

(2) Open chain polymer of ε-caprolactone (Mw=4000, melting point: 55° C.)

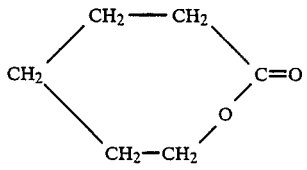

(3) Copolymer of Sebacic acid-decamethyleneglycol (Mw=3000, melting point: 74° C.)

(4) Copolymer of adipic acid-propyleneglycol (Mw=3000, melting point: 50° C.)

(5) Polymer of ω-hydroxydecanic acid (Mw=4000, melting point: 75° C.)

(6) Polymer of δ-valerolactone (Mw=4000, melting point: 54° C.)

Polyester waxes usable in this invention are not only the above-mentioned compounds which contain polyester in a state of block or graft but those containing alkyl or amide group as the end group, those containing one or more hydroxyl, amino, carboxyl or carbonyl group or those containing ether, amide, or urethane bonding in main or side chain.

Polyester usable in this invention are not limited to those synthesized by using dibasic acid, divalent alcohol, polybasic acid or polyvalent alcohol which are described above. Other various kinds of dibasic acids, divalent alcohols, polybasic acids or polyvalent alcohols can also be used.

Commercially obtainable polyester waxes are also usable such as: Series of Blaccel (product of Daicell Corp.); series of Elitel (product of Unitika Corp.).

(b) Amide wax:

Amide wax in this invention means a compound containing three or more amide bondings (—CO—NH—) in one molecule, having weight average molecular weight (Mw) in a range 300-12000 and melting point in a range 30°-120° C.

The amide group is contained in the main chain.

Amide wax is generally obtainable by reactions such as the polymerization of dibasic acid and diamine, the selfcondensation reaction of ω-amino acid, and the open-chain polymerization of lactam compounds.

Adjusting, or especially, lowering of the melting point of amide waxes is preferable by N-alkylation of polyamide radical.

N-alkylation is carried out by mixing dibasic acid and the mixture of diamine and N-alky or N,N'-dialkyl diamine or by using an ω-N-alkyl amino acid corresponding to ω-amino acid.

A practically obtainable example of this kind polymer is ω-N-methylaminoundecanic acid polymer (Mw=about 5000, melting point: 60° C.). Commercially obtainable example is HT-W Series of Sanwa Chemical Co.

Both the polyamide waxes containing polymide in a state of block type or graft type or polyamide waxes having alkyl or amide group as the end group can be used. Polyamide waxes having ether group, amide group or urethane group in main or side chain can also be used.

In this invention, polyurethane wax means a compound having a weight average molecular weight (Mw) in a range 300–12000 and a melting point in a range 30°–120° C. and containing three or more urethane bonding (—NH—CO—O—) in one molecule. The above-mentioned urethane bonding exists in the main chain of the molecule.

In general, polyurethane wax can be obtained by, for example, a polymerization-addition reaction between an isocyanate and glycol or some other methods such as condensation reaction, etc. Its actual example is the condensation-polymerization products of hexamethylenediisocyanate and hexane-2,5-diol (Mw=about 1200, melting point: 86° C.). Ether bonding, amide bonding or urethane bonding can be included in a part of main or side chain of the molecule.

Polyester waxes, polyamide waxes and polyurethane waxes above-mentioned include those containing vinyl bonding chain (C=C) in a molecule as block- or graft-copolyer.

These waxes are useful to adjust the adhesive power between the anchor layer and the fusible colorant layer (described below). And, moreover, they can increase the adhesive power between the anchor layer and the support with simultaneously decreasing the coagulating power of the anchor layer. Percentage of wax added in the anchor layer should be 70 wt % or lower to the total amount of the anchor layer components or, more preferably, lower than 60 wt %.

Above-mentioned surface active agent can act to adjust the peeling ability of the fusible colorant layer. Various kinds of surface active agents are applicable such as those containing polyoxyethylene chain which have been used in conventional thermal transfer recording mediums. Percentage of surface active agent in the anchor layer is usually lower than 30 wt %.

In this invention the anchor layer containing above-mentioned components is applied on the support by way of, for example, aqueous coating method safely, easily and uniformly under the excellent productive stability.

Thickness of anchor layer is usually 0.05–3 μm, or preferably 0.1–1.5 μm. If this thickness is lower than 0.05 μm, the existence of the anchor layer becomes actually meaningless since the purposes of this invention can not be obtained which are the improvement of image quality by the renovation of peelability of fusible colorant layer and is to obtain easily readable printed image through removal of lusterness. The anchor layer having the thickness larger than 3 μm cannot expect a meaningful result.

Another important point of this invention is the existence of the anchor layer between the support and the fusible colorant layer. The anchor layer contains an adhesive resin which can bind the support body and makes the irregularity on its surface. That is to say, the surface of the anchor layer has many ups and downs and this irregularly waving surface is the boundary of this layer with the fusible colorant layer which will be described in detail next.

The anchor layer has important roles in this thermal transfer recording medium which are (1) the function to remove the lusterness of the surface of printed image by making fine irregularity on the surface of the fusible colorant layer which is transferred on another transferable medium such as an ordinary sheet of paper and (2) the function to accelerate the surface peeling of the fusible colorant layer resulting to produce a good quality print. Moreover, since the anchor layer does not contain a filling agent to make the irregularity on the surface of printed images like conventional matt-layer of thermal transfer recording medium, it is excellent in the productive steadiness and can remove the lusterness of the surface of printed images uniformly and completely.

Fine irregularity on the surface of the printed image is produced by the action of many fine ups and downs of the surface of anchor layer. The average dimension of this ups and downs on the surface of anchor layer is in a range between 0.2–1.5 μm or, preferably, between 0.5–1.5 μm.

By making this average dimension in the range described above, fine irregularity can be produced in the boundary layer between the anchor layer and the fusible colorant layer and the original purpose of this invention to obtain high quality and lusterless print is obtainable completely. On this anchor layer the fusible colorant layer is accumulated which will be described in detail in the next sentences.

Fusible colorant layer

The fusible colorant layer usually contains a coloring material, a fusible material and a thermoplastic resin. The thickness of this layer is normally in a range 0.5–8 μm or, preferably is in a range 1.0–6.0 μm. Various organic and inorganic pigments and dyestuffs can be used as coloring materials. Examples of inorganic pigments are: titanium dioxide, carbon black, zinc oxide, prussian blue, cadmium sulfide, iron oxide and chromates of lead, zinc, barium and calcium.

Examples of usable organic pigments are: azo-, thioindigo-, anthraquinone-, anthoanthrone- and triphendioxazine-pigments, vat-dye pigments, and phthalocyanine pigments such as copper-phthalocyanine pigments and their derivatives and quinacridone pigments.

Examples of organic dyestuffs are: acid dyes, direct dyes, dispersion dyes, oil-soluble dyes and metal-containing oil-soluble dyes.

Percentage of coloring materials contained in the fusible colorant layer is usually in a range 5–35 wt % and, preferably is in a range 10–25 wt %. Examples of the fusible materials are: vegetable waxes such as carnauba wax, Japan tallow, auricula wax, esparto wax; animal waxes such as honey wax, insect waxes, shellac wax and whale wax; petroleum waxes such paraffin wax, microcrystal wax, polyethylene wax and acid wax; mineral waxes such as montan wax, ozokerite and ceresin wax. Moreover various chemical substances are usable; examples are: higher fatty acids such as palmitic acid, stearic acid, amargaric acid, behenic acid, higher alcohols such as palmityl alcohol, stearyl alcohol, behenyl alcohol, margaryl alcohol, myricyl alcohol and eicosanol; higher fatty acid esters such as cetyl palmitate, myricyl palmitate, cetyl stearate and myricyl stearate; amides such as acetamide, propionic amide, palmitic amide, stearic amide and amide waxes; higher amines such as stearyl amine, behenyl amine and palmityl amine. These can be used either two or more mixtures or independently. Especially preferable ones are a group of waxes having a melting point in a range 50°-100° C. which is measured with Yanagimoto MJP-2 type.

Examples of usable thermoplastic resins are: ethylene type copolymers, polyamide type resins, polyester type resins, polyurethane type resins, polyolefin type resins, acrylic type resins, vinyl chloride type resins, cellulose type resins, rosin type resins, ionomer resins and petroleum type resins; elastomers such as natural rubber, styrene-butadiene rubber and chloroprene rubber; rosin derivatives such as ester gum, rosin-maleic acid resin, rosin-phenol resin and hydrogenated rosin; other high molecular compounds having softening points in a range 50°-150° C. such as phenol resin, terpene resin, cyclopentadiene resin. These can be used independently or as a mixture of two or more kinds.

In the fusible colorant layer, surface active agents such as organic compounds containing polyoxyethylene chain can be mixed so as to adjust the peelability of the layer.

Percentage of fusible material in the fusible colorant layer is higher than 50% of the total of fusible material and thermoplastic resin; preferably is in a range 50-97% and, more preferably, in a range 60-95%.

If the above-mentioned percentage is lower than 50%, there is the possibility to degrade the peelability.

Inorganic or organic granules (metal powder, silica gel etc.) or oily substances (linseed oil and mineral oil) can also be added.

Others

In this invention another layer, that is, a thermo-softening layer can be applicable between the anchor layer and the fusible colorant layer. This layer is usually composed of above-mentioned thermoplastic resin and fusible material and its thickness is usually 0.6-8.0 μm and, preferably in a range 1.0-6.0 μm. Moreover, an overcoat layer can be piled on the fusible colorant layer.

[Manufacturing method of thermal transfer recording medium]

Manufacturing method of thermal transfer recording medium in this invention should be described.

At first, the above-mentioned anchor layer is applied on the above-mentioned support which is composed of above-mentioned materials. An important point of this invention is to make many ups and downs on the anchor layer by setting the surface with irregular unevenness of the level.

For this purpose, the incomplete level coating with gravure roll coating procedure can be applied. Here, the word "incomplete" means that unevenness of the surface of the anchor layer should be made in a range 0.2-1.5 μm, or preferably in a range 0.5-1.5 μm.

The unevenness of the anchor layer described above is easily obtained by coating the above-mentioned mixture of resin component and the solvent on the anchor layer and then drying according to the invention.

Physical properties of the above-mentioned coating liquid are: viscosity is larger than 100 cp, or preferably larger than 150 cp; or, yielding strength is larger than 15 dyne/cm, or preferably larger than 25 dyne/cm. These values are necessary since the unevenness of the anchor layer is determined with conditions such as viscosity and yielding strength of the coating solution, drying time and surface tension.

If the viscosity or yielding strength of the coating solution deviates from the above-mentioned values the unevenness of the anchor layer surface deviates from the above-mentioned value.

The drying time cannot determined unconditionally since it depends on the combination of resin component and solvent and the thickness of coating film. Usually it is in a range 1 second to 1 minute.

Usable solvents are: various alcohols such as methanol, ethanol, isopropyl alcohol, n-butanol, methyl cellosolve, ethyl cellosolve, butyl cellosolve; various esters such as methyl acetate, ethyl acetate, n-butyl acetate; various ketones such as acetone, methylethyl ketone, methylisobutyl ketone, cyclohexanone; aromatic hydrocarbons such as benzene, toluene, xylene; aliphatic hydrocarbons such as n-hexane, cyclohexane. They can be used independently or as a mixture of two or more kinds.

Percentage of resin component in the coating solution of anchor layer is usually 1-60 wt % or preferably 2-50%. The shapes of the concave part (cell) of the gravure roll which are applicable in the gravure roll coating method should be irregular ones of pyramid type, grating type, slope line, and irregular patterns obtained with electronic curving. If the figuring of electronic curving is regular the so-called moire pattern may be formed. It is also practicable to coarsen the surface of the above-mentioned type cell by using an organic solvent or electroplating technique.

The depth of the above-mentioned concave part (cell) is usually 0.1-100 μm or preferably 0.5-60 μm.

Figure 4:
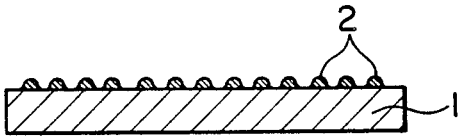
FIG. 4 shows an embodiment in which the anchor layer has an irregular surface.

Above-mentioned anchor layer which is obtained with gravure roll coating method can cover the whole surface of the above-mentioned support; or, as shown in FIG. 4, the anchor layer 2 can cover some part of the surface of the support 1 and a part of the support can be barely scattered. The unevenness is also obtainable by repeated coating with gravure roll method.

When the anchor layer is formed by exposing the support scatteredly, the distance between the support and difusible colorant layer can be shortened. Since then, there is no possibility that the sensitivity of the thermal transfer recording medium is lowered remakably.

Another method to make the irregularity on the surface of the anchor layer is to perform some operation on the support to disturb the smoothness of the coated wet surface until the coated film on the anchor layer is dried up.

The above-mentioned coating solution of the anchor layer usually built up the coating film on the support.

Various coating method is applicable such as: coating with a wire bar; gravure coating method; kiss-coating method; comma doctor coating method and air-knife roll coating method.

The thickness of the coated film is usually 0.2-2 μm or preferably 0.5-1.5 μm.

In this invention, the operation to disturb the smoothness of the coated surface is carried out until the film is dried up.

This operation is carried out by touching a brush or a feather on the coated surface; touch-rolling or electric discharging method is also applicable.

Anyhow, it is important to make the unevenness of the surface of the anchor layer in a range above-mentioned.

The above-mentioned fusible colorant layer which is piled on the anchor layer can be coated with water paint coating, organic solvent coating or hot-melt coating method.

The thermal transfer recording medium of this invention can be manufactured by passing the drying process, surface-smoothing process and cutting into various figures according to the customer's choice.

The thermal transfer recording medium manufactured with these processes is usable as various shapes such as wide-width tape used for line printers and typewriter ribbons. Preferable shape of this medium in this invention is a sheet type having the width same as that of the recording paper used for line printers.

This thermal transfer method used in this thermal transfer recording medium is not different from ordinally thermal transfer recording method. The process should be explained by using the most typical case which uses thermal head as the heat source.

The fusible colorant layer of the thermal transfer recording medium and the objective medium (transfer paper, for example) are closely contacted at first. If necessary, heat pulse is given from the back side of the transfer paper with the platten. At the same time, heat pulse is given with the thermal head and the fusible colorant layer corresponding to the printing or transfer pattern is locally heated. Temperature of the heated part of the fusible colorant layer is elevated resulting the quick softening of the layer and transfer of the image is completed.

EXAMPLES

The examples of this invention and reference examples and more practical explanation of this invention are shown. Hereinafter, "part" means "weight part".

Example 1

The anchor layer composite (its composition is indicated below) is coated on the film of polyethylene telephthalate (thickness is 4.5 μm) with aqueous coating method for the length equivalent to the longer side of A4 (JIS paper standard) paper resulting the formation of the anchor layer of thermal transfer recording medium of this invention.

| Composition of anchor layer | |
|---|---|
| Water-soluble polyester ("Byloner MD-12000": make of Toyobo) | 55 parts |
| Carbon black dispersion (mean diameter 62 μm, oil absorption (DBP) 67 ml/100 g) | 25 parts |
| Paraffin wax | 20 parts |

Then, the following thermally fusible colorant layer composition is coated on the anchor layer with hot-melt coating method using wire-bar making the thickness of film 4.2 μm and the thermal transfer recording medium of this invention is prepared.

| Thermally fusible colorant layer composition | |
|---|---|
| Paraffin wax | 40 parts |
| Ester wax | 20 parts |
| Carbon black | 25 parts |
| Ethylene-vinyl acetate copolymer | 14 parts |

The obtained thermal transfer recording medium is tested by printing on a sheet of ordinary paper (Beck smoothness is 50 seconds) using a thermal printer (260 mm width line head, 180 DPI, hardness of platten rubber: 40°) and the secret preservability of the printed image, lusterness and the quality of printed letter are tested.

The results are shown in Table 1.

Secret preservability, lusterness and the quality of printed letter are evaluated with following methods.

Secret preservability: The condition of the void after printing is tested with naked-eye observation using reflected light.

Lusterness: Lusterness of printed image is measured by using lusterness meter under conditions that angles of incidence and reflection are 60°

Quality of printed letter: Void and sharpness are observed with naked-eyes.

Example 2–6

Just the same tests as Example 1 are carried out by using the anchor layer composition shown in Table 2 instead of those used in Example 1. The results are shown in Table 1.

Example 7

The thickness of the anchor layer is changed from 1.0 μm to 0.5 μm. Other conditions are same as those in Example 1. The results are shown in Table 1.

Reference examples 1–3

Thermal transfer recording medium is manufactured with the same procedure as described in Example 1 except the use of the anchor layer whose composition is shown in Table 2 and the secret preservability, lusterness and the quality of print are evaluated. The results are shown in Table 1.

Reference example 4

Thermal transfer recording medium is manufactured with the same procedure as described in Example 1 except the use of the anchor layer containing titanium white (mean diameter=1.07 μm) instead of that containing carbon black. The secret preservability, lusterness and the quality of print are evaluated. The results are shown in Table 1.

Reference example 5

Thermal transfer recording medium is manufactured with the same procedure as described in Example 1 except that the anchor layer is not prepared. The secret preservability, lusterness and the quality of print are evaluated. The results are shown in Table 1.

TABLE 1

| | Secret preservability | Lusterness | Print quality |
|---|---|---|---|
| Example 1 | ◎ | 13 | ○ |
| Example 2 | ◎ | 9 | ◎ |
| Example 3 | ◎ | 7 | ◎ |
| Example 4 | ◎ | 8 | ◎ |
| Example 5 | ◎ | 4 | ◎ |
| Example 6 | ◎ | 2 | ◎ |
| Example 7 | ◎ | 14 | ○ |
| Reference example 1 | Δ | 35 | Δ |
| Reference example 2 | Δ | 36 | Δ |
| Reference example 3 | Δ | 31 | Δ |
| Reference example 4 | x | 20 | Δ |
| Reference | x | 35 | x |

TABLE 1-continued

| | Secret preservability | Lusterness | Print quality |
|---|---|---|---|
| example 5 | | | |

Sign in the table means as the following:
Secret preservability:
◎: The figure corresponding to the printed image of the anchor layer is impossible to read.
Δ: The figure corresponding to the printed image of the anchor layer is possible to read.
x: The figure corresponding to the printed image of the anchor layer is very easily readable.
Quality of print:
◎: Both the conditions of the void and the sharpness of the print are fine.
○ : The void is small but the sharpness is inferior.
x: Both the void and the sharpness are inferior.

TABLE 2

| | Water-soluble polyeste | Carbon black dispersion | Paraffin wax |
|---|---|---|---|
| Example 2 | 50 | 30 | 20 |
| Example 3 | 45 | 35 | 20 |
| Example 4 | 40 | 40 | 20 |
| Example 5 | 30 | 50 | 20 |
| Example 6 | 20 | 60 | 20 |
| Reference example 1 | 60 | 20 | 20 |
| Reference example 2 | 65 | 15 | 20 |
| Reference example 3 | 70 | 10 | 20 |

(Evaluation)

As indicated in Table 1, the thermal transfer recording medium of this invention is confirmed to be excellent compared to those of Reference examples in the secret preservability and the quality of printed image and also lower in lusterness of printed image.

When other kind of filling agent is used instead of carbon black as shown in Reference example 4, the unevenness of coating is observed in the anchor layer.

Example 8

Coating solution of the anchor layer (solid concentration: 65%) is prepared by diluting the composition of the anchor layer with the soluvent (a mixture of methylethylketone and toluen in a ratio 1:1) on polyethylene telephthalate film (thickness: 4.5 μm).

This coating solution is applied on a sheet of paper having a length of the long side of A4 in JIS standard with the gravure roll coating method (drying time: 0.2 minute). The anchor layer is obtained having many scattered ups and downs whose average difference in heights is 0.6 μm. Gravure roll having cells of a trapezoid type (250 lines/inch) is used.

| Anchor layer composition | |
|---|---|
| Polyester ("Bylon 200": make of Toyobo) | 80 wt % |
| Carbon black dispersion | 20 wt % |

Thermal transfer recording medium of this invention is prepared by forming the thermally fusible colorant layer with the method as follows:

Thermally fusible colorant layer composition having a below-mentioned recipe is coated with hot-melt coating procedure on the anchor layer with a film thickness 3.2 μm by using a wire bar.

| Thermally fusible colorant composition | |
|---|---|
| Paraffin wax | 50 wt % |
| Carnauba wax | 20 wt % |
| Carbon black | 18 wt % |
| Ethylene vinylacetate copolymer | 12 wt % |

Recording (printing) operation is carried out by using the obtained thermal transfer recording medium and a thermal printer (260 mm width line head; 180 DPI, platten rubber hardness 40°) on a sheet of ordinary paper (Beck smoothness: 50 seconds). Sensitivity, the quality of printed image and lusterness are evaluated. The results are shown in Table 3.

Evaluation of the quality of printed image and lusterness is carried out with the following judgement.

Sensitivity: The figure of printed image is observed by printing with applied energy 1 mJ/dot.

Quality of print: The void and the sharpness are observed with naked-eye observation.

Lusterness: Lusterness of printed image is measured with a lusterness meter under conditions that the incident and reflected angles of light are 60°.

Example 9

Coating is carried out by using a wire bar instead of gravure roll coating method in Example 8. The anchor layer which has many ups and downs (mean difference of height is 0.48 μm) are made by touching a feather on the coated film surface before the anchor layer dries up which is 0.9 μm thick Other conditions are same as shown in Example 8. The sensitivity, the quality of printed image and the lusterness of this thermal transfer recording medium are evaluated. The results are shown in Table 3.

Comparative

Thermal transfer recording medium is manufactured with the same procedure as described in Example 8 except that the anchor layer composition shown below is used and coated to be 1.6 μm thick by using a wire bar instead of a gravure roll. The evaluation is carried out in the same manner as in Example 8. The results are shown in Table 3

| Anchor layer composition | |
|---|---|
| Polyester ("Bylon 200": make of Toyobo) | 50 wt % |
| Titan white (means particle diameter >1.0 μm) | 50 wt % |

TABLE 3

| | Sensitivity*1 | Quality of print*2 | Lusterness |
|---|---|---|---|
| Example 8 | | | 14 |
| Example 9 | | | 18 |
| Reference example 6 | | | 31 |

*1: Printing is possible using applied energy of 1 mJ/dot.
*2: The void and the sharpness are fine.

(Evaluation)

As shown in Table 3, the thermal transfer recording medium of this invention is confirmed that a printed having lower lusterness and easier readability compared to those of Comparative 6.

Example 10

Water coating is carried out by applying the anchor layer whose composition is shown in the table below on polyethylene telephthalate film in a length of the long side of A4 in JIS standard with thickness 1.0 μm. The anchor layer of the thermal transfer recording medium of this invention is prepared.

| Anchor layer composition | |
|---|---|
| Polyester wax type emulsion ("Blaccel 220N": Daicell Chemical Co.) | 30 wt % |
| Polyester resin (Byloner 200) | 50 wt % |
| Water dispersion of carbon black | 20 wt % |

The thermal transfer recording medium of this invention whose colorant layer is 4.0 μm thick is prepared, by coating the thermally fusible colorant composition shown below on the above-obtained anchor layer.

| Thermally fusible colorant composition | |
|---|---|
| Paraffin wax emulsion | 60 wt % |
| Acryl emulsion | 10 wt % |
| Ethylene-vinylacetate copolymer emulsion | 10 wt % |
| Carbon black dispersed in water | 20 wt % |

Printing test is carried out by applying the obtained thermal transfer recording medium with a thermal printer (260 mm width line head, 180 DPI, platten rubber hardness 40°) on a sheet of ordinary paper (Beck smoothness: 20 seconds) and the lusterness of printed image, the quality of the print and the film holding are evaluated. The results are shown in Table 4.

The evaluation methods of lusterness, the quality of print and the film holding are as follows:

Lusterness: Lusterness of printed image is measured by using a lusterness meter under conditions of incident and reflected light angles 60°.

Quality of print: The void and the sharpness are observed with naked eyes.

Film holding: Peeling test (adhesive releasing angle 60°) is carried out by using adhesive tape (Post-it; product of 3M Co.) and the presence of peeling is checked.

Examples 11–14

By using the anchor layer composition shown in Table 5, the test is carried out under other conditions are same as those in Example 10. The results are shown in Table 4.

(Evaluation)

As shown in Table 4, the thermal transfer recording medium of this invention has a low lusterness of printed image, excellent print quality and film holding.

TABLE 4

| | Lusterness | Quality of print | Film holding |
|---|---|---|---|
| Example 10 | 4 | ◎ | ○ |
| Example 11 | 8 | ○ | ○ |
| Example 12 | 5 | ○ | ○ |
| Example 13 | 4 | ◎ | ○ |
| Example 14 | 4 | ◎ | ○ |

Signs in the table indicate as follows:
Quality of print:
◎: Both the void and the sharpness are fine.
○: The void is fine but the sharpness is inferior
Film holding:
○: No peeling of adhesive tape is observed.

TABLE 5

| | The anchor layer composition | | | | | |
|---|---|---|---|---|---|---|
| | Compounds group A (wt %) | | | | | |
| | Polyurethane wax*1 | Polyamide wax*2 | Polyester wax*3 | Polyurethane wax*4 | Resin component (wt %) Polyester*5 | Other (wt %) Carbon black |
| Example 11 | 30 | — | — | — | 50 | 20 |
| Example 12 | — | 30 | — | — | 50 | 20 |
| Example 13 | — | — | 30 | — | 50 | 20 |
| Example 14 | — | — | — | 30 | 50 | 20 |

*1Commercial name: HSW-Cl, product of Hodogaya Chemical
*2Commercial name: HT-W-70B, Product of Sanwa Chemical
*3Commercial name: Elitel XA80020, Product of Unitika
*4Commercial name: XVW-190, Product of Sanyo Kaseo
*5Commercial name: Byloner 200, Product of Toyobo Co.

Explanation of figures

FIG. 1 and FIG. 3 are the explanation of an example of thermal transfer recording medium of this invention.

FIG. 2(*a*) is a schematical cross-section figure indicating the state of the boundary between the anchor layer and the thermally fusible colorant layer of the thermal transfer recording medium of this invention.

FIG. 2(*b*) indicated the cross sectional view of the printed image obtained with the thermal transfer recording medium shown in FIG. 2(*a*).

FIG. 4 is a schematical cross-section figure indicating the anchor layer scattered on the support.

1: Support
2: Anchor layer
3: Thermally fusible colorant layer

What is claimed is:

1. A thermal transfer recording medium comprising a support, and coated on said support, an anchor layer which is operable to remain substantially on said support and not be transferred when the thermal transfer recording medium is used, and coated on said anchor layer, a thermally fusible colorant layer, wherein said anchor layer contains a resin component and not less than 25% by weight of carbon black, and said colorant layer contains carbon black.

2. The medium of claim 1, wherein said carbon black content of said anchor layer is not less than 30% by weight.

3. The medium of claim 1, wherein said resin component has a softening point of not less than 100° C.

4. The medium of claim 1, wherein said resin component has a softening point of not less than 150° C.

5. The medium of claim 1, wherein oil absorption of said carbon black is not less than 20 ml/100 g.

6. The medium of claim 1, wherein oil absorption of said carbon black is from not less than 100 ml/100 g to 300 ml/100 g.

7. The medium of claim 1, wherein the mean diameter of said carbon black is not more than 100 mμ.

8. The medium of claim 1, wherein said anchor layer has a matted surface.

9. The medium of claim 1, wherein said anchor layer further contains at least one compound selected from polyester wax, polyamide wax and polyurethane wax.

10. The medium of claim 1, wherein the thickness of said anchor layer is 0.1 to 1.5 mμ.

* * * * *